US005265440A

United States Patent [19]

Baker

[11] Patent Number: 5,265,440

[45] Date of Patent: Nov. 30, 1993

[54] TEMPERATURE CONTROL CHAMBER

[75] Inventor: George C. Baker, Glendale, Ariz.

[73] Assignee: Skyline Metal Products, Inc., Phoenix, Ariz.

[21] Appl. No.: 11,871

[22] Filed: Feb. 1, 1993

[51] Int. Cl.[5] ..... F25D 3/08

[52] U.S. Cl. ..... 62/371; 62/457.1; 62/292; 220/429

[58] Field of Search ..... 62/371, 372, 400, 457.2, 62/457.1; 220/426, 428, 429, 465, 467

[56] References Cited

U.S. PATENT DOCUMENTS

| | | | |
|---|---|---|---|
| 386,769 | 7/1888 | Cobb | 62/400 |
| 3,125,863 | 3/1964 | Hood . | |
| 3,443,397 | 5/1969 | Donovan . | |
| 4,633,678 | 1/1987 | Lea et al. | 62/400 |
| 4,642,999 | 2/1987 | Justice . | |
| 4,761,961 | 8/1988 | Marx . | |
| 4,903,499 | 2/1990 | Merritt . | |
| 5,031,410 | 7/1991 | Plzak . | |
| 5,101,637 | 4/1992 | Daily . | |

*Primary Examiner*—John M. Sollecito

*Attorney, Agent, or Firm*—LaValle D. Ptak

[57] ABSTRACT

A temperature control chamber is designed for use with refrigerant recovery systems. The temperature control chamber comprises a main base portion, in the form of an upright container, with an open top. A refrigerant storage tank is placed in the container, which has dimensions such that the handle on the top of the storage tank extends beyond the top of the sides of the main base portion of the container. A rigid cover, with an aperture in its center, fits down over the open end of the main base portion; and the handle of the refrigerant storage tank extends through the aperture. A plurality of releaseable latches then secure the cover to the main base portion; so that when the refrigerant tank within the temperature control chamber is lifted and moved from place to place by means of its handle, the temperature control chamber also is lifted by the interaction of the top of the tank with the cover pressing downwardly on the top of the tank. The space between the tank and the sides of the temperature control chamber may be filled with heat exchange materials, such as ice or dry ice.

18 Claims, 1 Drawing Sheet

TEMPERATURE CONTROL CHAMBER

BACKGROUND

New regulations in the United States and other countries require persons servicing air conditioner units and refrigeration units, such as refrigerators, freezers, and the like, to evacuate and recover the refrigerant (usually freon) which is removed from such systems without venting it to the atmosphere. This requirement is a substantial change from past practices, where freon and other refrigerants simply were vented to atmosphere during such repair or servicing operations.

These new regulations have resulted in the necessity for providing refrigerant recovery systems, which typically remove the refrigerant from the unit undergoing servicing, and supply that refrigerant, under pressure, to an approved storage tank. The storage tanks are similar to small portable propane gas tanks and the like, and are made to be carried by the service persons to and from the job site.

When the refrigerant is removed and supplied to the storage tank, it is quite hot. In some areas of the country, such as Arizona in the summertime, where the ambient temperature, particularly for roof air conditioners, can approach and exceed 115° F., the efficiency of removal of refrigerant at such high temperatures is significantly impaired. As a consequence, it has been found necessary to cool the storage tank when it is being used to receive refrigerant removed from a system undergoing servicing. To accomplish this, some relatively complex refrigerant recovery systems have been developed. Three such systems are disclosed in the U.S. Pat. Nos. 4,761,961; to Marx Merritt 4,903,499; and Daily 5,101,637.

The Marx patent is directed to a refrigerant recovery system in which the recovery tank is cooled by a bath of liquid nitrogen in a Dewar Vessel 13. The requirement for the use of liquid nitrogen in this refrigerant recovery system results in an expensive, cumbersome apparatus.

The Daily U.S. Pat. No. 5,101,637 is directed to a refrigerant recovery system employing cryogenic cooling of the refrigerant container. The Daily system also uses liquid nitrogen to cool a jacket around the refrigerant container. The liquid nitrogen is vented to air, after the cooling function is completed by expansion of the nitrogen. The liquid nitrogen must be replenished; and it requires a separate tank in addition to the other components of the refrigerant recovery system.

The Merritt U.S. Pat. No. 4,903,499 also is directed to a relatively complex refrigerant recovery system. In Merritt, an annular jacket surrounds a special purpose storage bottle, which is provided with a valve-operated drain. Within the jacket, a puddle of refrigerant forms; and refrigerant is withdrawn from this puddle through a suction tube, and supplied to a low pressure suction line. The jacket functions to maintain the special recovery bottle at a low temperature to enhance the overall efficiency of the system. The non-standard recovery bottle, along with the specially constructed jacket, results in an expensive and cumbersome system.

Two patents, which are directed to beer keg coolers, are the U.S. Pat. Nos. 3,443,397 to Donovan and Justice 4,642,999. The Donovan patent is a double-walled device made of flexible material. A beer keg is placed in the container, and the spigot at the bottom of the keg extends through a sealed opening in the container bottom, to provide access to the keg. The inner portion of the container then is secured over the top of the keg; and the space between the inner and outer portions may be filled with ice. A lid is secured by means of a zipper, and handles are provided on the outer container to permit carrying of the ice-filled container and keg from one position to another.

The Justice patent discloses a foamed polystyrene cylindrical container, having a bottom portion and a cover. A keg of beer is placed in the bottom portion of the cooler. This portion forms a bucket; and ice is placed around the beer keg in the space between this lower bucket portion and the keg. The top of the Justice container then is fitted onto the bottom portion. This top has a circular opening in it for centering the outlet of the keg, which is placed in the container. Access to the keg then is obtained through the conventional keg outlet, which extends upwardly through the circular opening in the top of the container. The container top is not secured in any way to the bottom; and no handles for carrying the container with a keg inside are provided. If the keg is lifted, the container top simply is lifted off the bottom along with the keg. If the container is to be moved from place to place, it must be grasped from the bottom and carried. From the design of this container, it is apparent that it is not intended to be moved about from place to place, once it is filled.

It is desirable to provide an improved temperature control chamber for a refrigerant recovery system, which overcomes the disadvantages of the prior art noted above, is simple to use, low in cost, and which is readily portable.

SUMMARY OF THE INVENTION

It is an object of this invention to provide an improved temperature control chamber.

It is another object of this invention to provide an improved temperature control chamber for use with a refrigerant recovery system.

It is an additional object of this invention to provide an improved portable temperature control chamber for use with a refrigerant recovery system.

It is a further object of this invention to provide an improved temperature control chamber for the recovery tank of a refrigerant recovery system, which may be transported from point to point by means of a handle on the recovery tank.

In accordance with a preferred embodiment of this invention, a temperature control chamber has a main base portion with a bottom and upwardly-extending sides. A refrigerant recovery storage tank may be placed in the main base portion; and the space between the exterior of the tank and the sides of the base portion may be filled with heat exchange material, such as ice. A rigid cover member is releaseably fastened to the sides of the main base portion to close the upper open end of the base portion. The cover has an aperture in it to permit a handle on the storage tank to extend through the aperture. The aperture is dimensioned so that the rigid cover member overlies the storage tank within the main base portion. When the storage tank is carried by the handle extending through the aperture in the cover member, the cover member supports the main base portion on the storage tank as the storage tank and temperature control chamber are moved together from one place to another.

DETAILED DESCRIPTION

Figure 2:
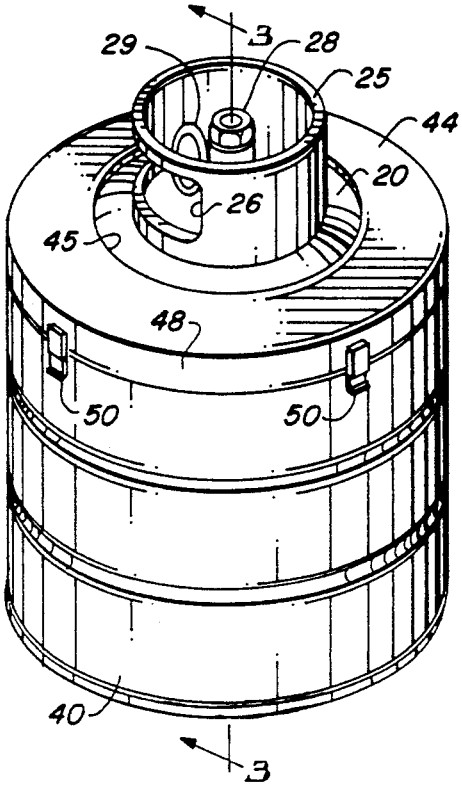
FIG. 2 is a perspective view of a preferred embodiment of the invention.

Reference now should be made to the drawing, in which the same reference numbers are used in the different figures to designate the same components.

Figure 1:
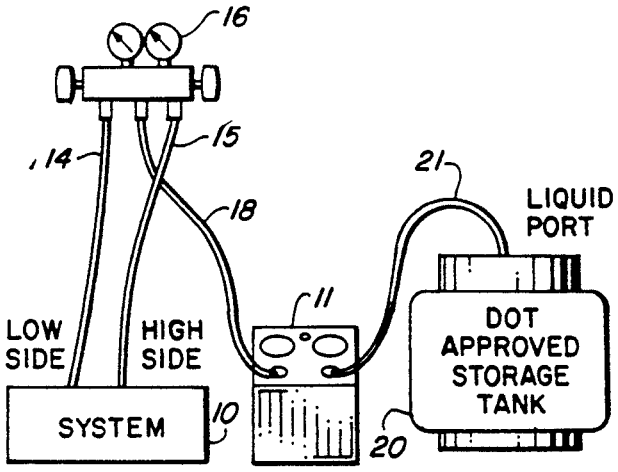
FIG. 1 is a diagrammatic representation of the system with which the invention is used.

FIG. 1 is a diagrammatic representation of a prior art refrigerant recovery system, with which the preferred embodiment of this invention is used. As shown in FIG. 1, the system 10 is the system which is to be evacuated. Such a system typically includes a compressor, condenser and evaporator, and other components, the details of which are not shown. A set of manifold gauges and valves 16 is connected with the system 10 by means of a low pressure hose 14 and a high pressure hose 15. A control unit 11 then controls the evacuation of refrigerant from the system 10; and that refrigerant is delivered over a line 21 to the input port of a refrigerant storage tank 20. The storage tank 20 must be an approved tank, capable of holding liquid refrigerant. Such tanks are comparable to the portable propane tanks which are widely used for recreational vehicles, portable gas grills, and the like.

It has been found that when the system of FIG. 1 is used in areas where the ambient temperature is high, there is difficulty in removing all of the refrigerant from the system 10 and storing it in the storage tank, since elevated ambient temperatures impair the desired level of recovery. In the more cumbersome systems, cryogenic cooling is employed. As noted above, however, such systems are expensive and cumbersome. An alternative approach has been simply to place the storage tank 20 in a large bucket filled with ice. It is difficult to handle the bucket, storage tank and all of the other equipment shown in FIG. 1, particularly when the unit 10, which is being serviced, is on the roof of a building, such as a roof air conditioner.

Figure 4:
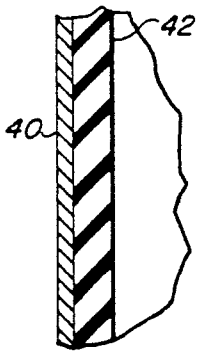
FIG. 4 is an enlarged cross-sectional view of the portion circled as 4 in FIG. 3.

To provide for cooling of the storage tank 20 in a relatively simple and efficient manner, the temperature control chamber shown in FIGS. 2, through 4 has been developed. This control chamber comprises a base portion 40, which has a closed bottom and an upstanding open topped cylindrical sides, essentially forming an open-ended bucket. While the base portion 40 may be made of a variety of materials, construction of this bucket-like base portion of galvanized steel has been found highly satisfactory. To improve the thermal insulating characteristics of the galvanized steel base portion 40, a rubber or neoprene lining 42 is placed on all of the interior walls of the bottom and sides of the base portion, as shown most clearly in FIGS. 3 and 4.

When the device is used, a refrigerant recovery storage tank 20, which has a bottom ring 22 and an upstanding valve protection ring 25 on it, is placed in the base portion 40 of the temperature control chamber. As is shown most clearly in FIG. 3, the bottom support ring 22 of the storage tank 20 rests on the liner 42 in the bottom of the base portion 40. The upper open edge of the base portion 40 is dimensioned to terminate at the neck of the container 20, where the valve protection ring 25 attaches to the upward sloped shoulders typically found on the top of the tank 20. Again, this is illustrated most clearly in FIG. 3.

The valve protection portion 25 has a handle opening or aperture 26 in it; and as is apparent from FIG. 2, the portion 25 encircles a connector 28 and valve 29 located on the top of the tank.

Figure 3:
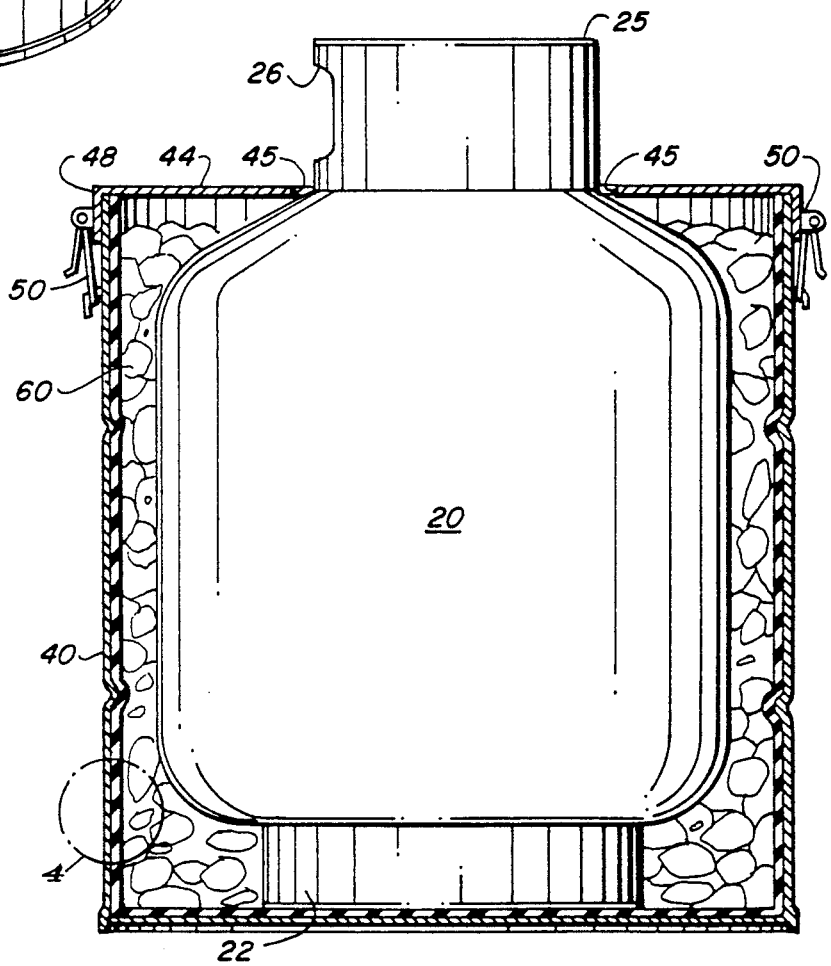
FIG. 3 is a section view taken along the line 3—3 of FIG. 2.

Once the tank 20 is in place, as shown in FIG. 3, the base portion 40 is filled with ice or dry ice 60. Then a circular top 44, having a circular aperture 45 in it, is placed over the open top of the base portion 40 of the temperature control chamber. As is readily apparent from an examination of both FIGS. 2 and 3, the top 44 has an external downwardly turned flange 48 formed on the outer edge which overlies the upper edge of the cylindrical base portion 40. A number of over-centering latches 50 then are used to securely releaseably fasten the top 44 to the sides of the base portion 40, as illustrated in FIGS. 2 and 3. The number of over-center latches 50 which are employed is selected to provide sufficient strength in interconnecting the parts together to permit the storage tank 20 and temperature control chamber 40/44 to be moved from place to place by lifting the storage tank through its conventional handle 26. When this is done, the upper shoulder of the storage tank 20 presses against the edge of the aperture 45 in the top 44 to permit the top 44 to lift the bottom portion 40 of the temperature control chamber by means of the latches 50, which secure the top to the sides 40. Consequently, the temperature control chamber and storage tank 20 may be moved from place to place as a unit, even when the space between the storage tank 20 and the bottom portion 40 of the temperature control chamber is filled with heat exchange material, such as ice or dry ice 60, as illustrated in FIG. 3.

When removal of the storage tank 20 from the temperature control chamber is desired, the over-center latches 50 are released, the top 44 is lifted off the top of the container portion 40. Then the storage tank 20 may be lifted out of the bottom portion 40 with minimal effort. It readily is apparent that the temperature control chamber, which has been disclosed above, significantly facilitates the movement of the storage tank and temperature control chamber from point to point. In fact, no more effort is required to move the tank and chamber together than normally is required simply to move the tank alone. The only difference is the additional weight of the temperature control chamber 40/44 and of the heat exchange material. This typically is not a significant increase in weight over the storage tank 20 alone.

The preferred embodiment of the invention, which is illustrated in the drawings and which has been described above, should be considered as illustrative only and not as limiting. Different materials may be used for the temperature control chamber, different types of latching mechanisms may be employed in place of the over-center mechanism which has been described, and various other changes and modifications will occur to those skilled in the art, without departing from the true scope of the invention as defined in the appended claims.

I claim:

1. A temperature control chamber including in combination:

a main base portion having a bottom, with sides extending upwardly therefrom a predetermined distance to form an open-ended container having dimensions selected to permit placement of a refrigerant storage tank therein, with space between the sides of said main base portion and said storage tank placed therein, said tank having handle means on the top thereof extending beyond the open end of said main base portion; and a rigid cover member releaseably fastened to the sides of said main base portion to close the open end thereof, said cover member having an aperture therein to permit the handle means of said storage tank to extend therethrough, said aperture having dimensions causing said rigid cover member to overlie at least a portion of said storage tank; so that when said storage tank is carried by the handle means extending through the aperture in said rigid cover member, said rigid cover member supports said main base portion on said storage tank as said storage tank is moved from one place to another.

2. The combination according to claim 1 wherein said main base portion comprises an open-ended cylinder with a circular bottom and wherein said sides comprise a cylindrical section.

3. The combination according to claim 2 wherein the space between the sides of said main base portion and said tank is adapted to be filled with heat exchange material.

4. The combination according to claim 3 wherein said rigid cover member is releaseably fastened to the sides of said main base portion at a plurality of spaced positions.

5. The combination according to claim 4 wherein said rigid cover member includes a first portion with said aperture therein located in a plane substantially parallel to the bottom of said main base portion and a downwardly depending edge portion extending therefrom to overlie the sides of said main base portion.

6. The combination according to claim 5 wherein the bottom and sides of said main base portion and said rigid cover member are made of metal.

7. The combination according to claim 6 further including liner means on the bottom and sides of said main base portion on the interior thereof.

8. The combination according to claim 7 wherein said liner means is a resilient insulating liner means.

9. The combination according to claim 8 wherein said fastener means comprise a plurality of over-center latches.

10. The combination according to claim 9 wherein said metal is galvanized steel.

11. The combination according to claim 1 wherein said rigid cover member is releaseably fastened to the sides of said main base portion at a plurality of spaced positions.

12. The combination according to claim 11 wherein said fastener means comprise a plurality of over-center latches.

13. The combination according to claim 1 wherein said rigid cover member includes a first portion with said aperture therein located in a plane substantially parallel to the bottom of said main base portion and a downwardly depending edge portion extending therefrom to overlie the sides of said main base portion.

14. The combination according to claim 6 further including liner means on the bottom and sides of said main base portion on the interior thereof.

15. The combination according to claim 14 wherein said liner means is a resilient insulating liner means.

16. The combination according to claim 1 wherein the space between the sides of said main base portion and said tank is adapted to be filled with heat exchange material.

17. The combination according to claim 1 wherein the bottom and sides of said main base portion and said rigid cover member are made of metal.

18. The combination according to claim 17 wherein said metal is galvanized steel.

* * * * *